United States Patent [19]

Van den Sype

[11] 4,204,885

[45] May 27, 1980

[54] METHOD FOR PROVIDING STRONG WIRE

[75] Inventor: Jaak S. Van den Sype, Scarsdale, N.Y.

[73] Assignee: Union Carbide Corporation, New York, N.Y.

[21] Appl. No.: 22,631

[22] Filed: Mar. 21, 1979

[51] Int. Cl.[2] ..... C21D 1/62; C21D 9/52

[52] U.S. Cl. ..... 148/12 B; 148/12 E; 148/12.4; 148/125

[58] Field of Search ..... 148/12 E, 12.3, 12.4, 148/125, 37, 38

[56] References Cited

U.S. PATENT DOCUMENTS

| | | | |
|---|---|---|---|
| 2,395,608 | 2/1946 | Aborn | 148/12 E |
| 2,974,778 | 3/1961 | Ellis et al. | 205/21 |
| 3,152,934 | 10/1964 | Lula et al. | 148/12.3 |
| 3,197,851 | 8/1965 | Aleck | 29/421 |
| 3,473,973 | 10/1969 | Maekawa et al. | 148/12.3 |
| 3,486,361 | 12/1969 | Vaneman et al. | 72/278 |
| 3,615,921 | 10/1971 | Delgrosso | 148/125 |
| 4,042,421 | 8/1977 | Van den Sype et al. | 148/12 E |
| 4,042,423 | 8/1977 | Van den Sype et al. | 148/12 B |

*Primary Examiner*—W. Stallard
*Attorney, Agent, or Firm*—Saul R. Bresch

[57] ABSTRACT

In a process for improving the strength characteristics of a wire composed of an austenitic metal alloy selected from the group consisting of stainless steel alloys of the AISI 200 and 300 series and non-stainless steel alloys containing iron, manganese, chromium, and carbon, comprising the following steps:

(a) deforming the wire at a strain of at least about 10 percent and at a temperataure in the range of about Md minus 50° C. to about Md plus 50° C., (b) cooling the wire to a temperature no higher than about minus 75° C.; and (c) drawing the cooled wire whereby the cross-sectional area of the wire is reduced by a certain percentage and the wire has a martensite phase of at least about 50 percent by volume and an austenite phase of at least about 10 percent by volume, the improvement comprising carrying to the drawing of step (c) by drawing the wire through two dies placed in series in such a manner that the cross-sectional area of the wire is reduced by the first die by a percentage in the range of about 8 to about 15 percent and the cross-sectional area of the reduced wire is further reduced by the second die by a percentage in the range of about 8 to about 15 percent based on the area of the wire exiting the first die.

5 Claims, 1 Drawing Figure

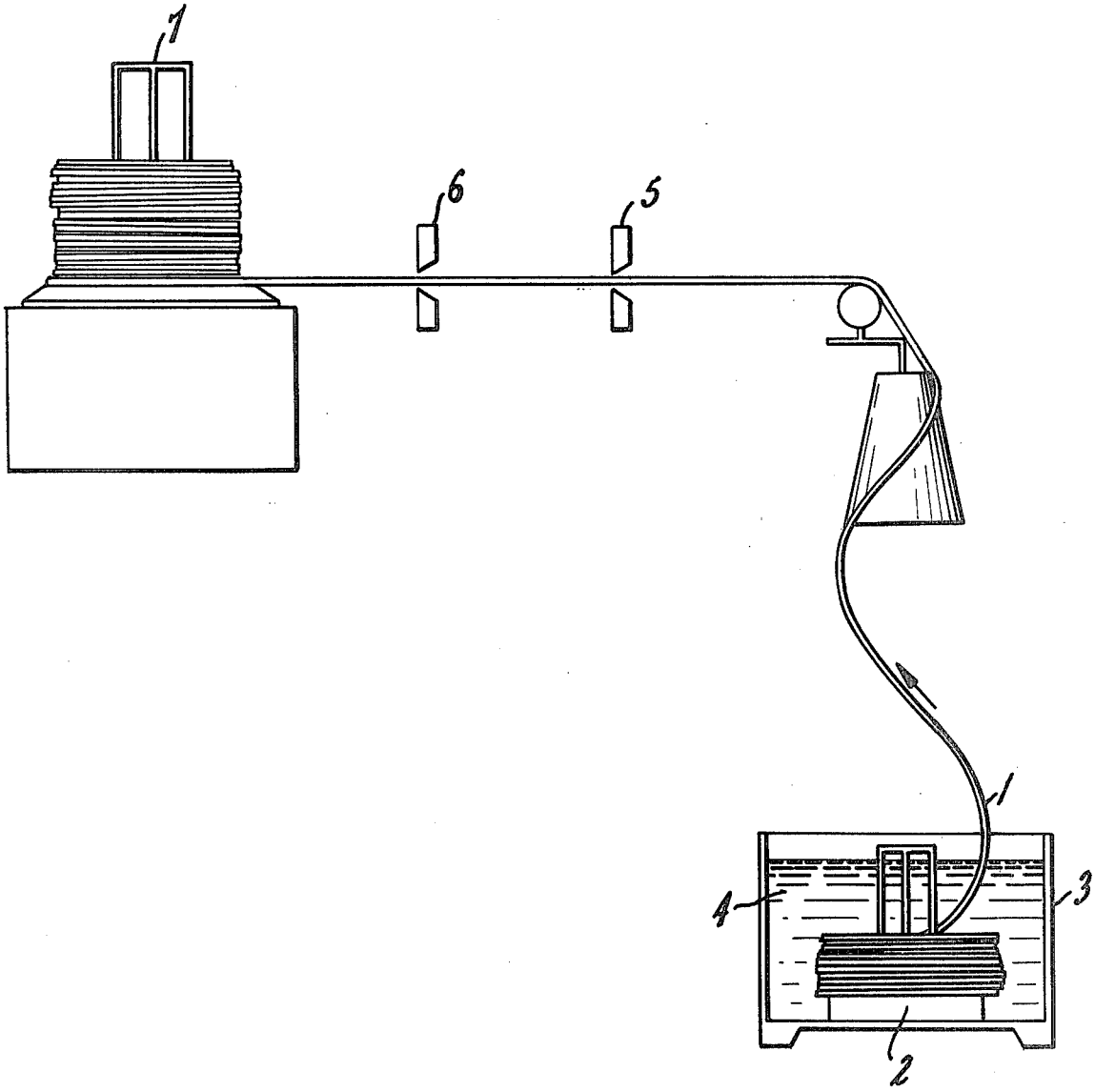
7
6
5
1
4
3
2

METHOD FOR PROVIDING STRONG WIRE

FIELD OF THE INVENTION

This invention relates to a process for improving the strength of wire, and, more particularly, to improving the tensile strength and the torsional yield strength characteristics of certain wire.

DESCRIPTION OF THE PRIOR ART

The chemical compositions of the metal alloys to which this invention is directed are well known and include those alloys listed in the "Steel Products Manual: Stainless and Heat Resisting Steels" published by the American Iron and Steel Institute (AISI) now of Washington, D. C. in 1974 and designated as austenitic with the further proviso that these alloys at least initially have an Md temperature of no higher than about 100° C. (i.e., plus 100° C.) and an Ms temperature no higher than minus 100° C. It will be apparent that the AISI Series Designation 200 and 300 are of interest here. Other alloys contemplated here, again, must be austenitic and have the stated Md and Ms temperatures. These alloys include certain manganese-substituted non-stainless alloys containing iron, manganese, chromium, and carbon exemplified by those designated by DIN (Deutsche Industrie Norme) specifications X40 Mn Cr 18 and X40 Mn Cr 22 and described on pages 655 and 656 of the Metallic Materials Specification Handbook published by E & FN Spon Ltd., London 1972.

The term "austenitic" involves the crystalline microstructure of the alloy, which is referred to as austenitic or austenite when at least about 95 percent by volume of the microstructure has a face-centered cubic structure. Such alloys can be referred to as being essentially or substantially in the austenitic phase. It is understood that the alloys of concern here are essentially in the austenitic or austenite phase at the temperature at which the first deformation step is carried out regardless of the work or temperature previously applied, e.g., the metal or alloy subjected to the first deformation step may have been previously annealed yet it is essentially austenitic when the first step is applied.

The other microstructure with which we are concerned here is a body-centered cubic structure and is referred to as martensitic or martensite. When at least about 95 percent by volume of the structure is martensitic, the alloy is considered to be essentially or substantially in the martensite phase.

The microstructure can, of course, contain both an austenite phase and a martensite phase and the processing to be discussed here both in terms of the prior art and the present invention is one of transformation of at least part of the austenite to martensite thus changing the microstructure of the alloy treated.

The Md temperature is defined as the temperature above which *no* martensitic transformation will take place regardless of the amount of mechanical deformation which is applied to the metal or alloy and can be determined by a simple and conventional tensile test carried out at various temperatures.

The Ms temperature is defined as the temperature at which martensitic transformation *begins* to take place *spontaneously,* i.e., without the application of mechanical deformation. The Ms temperature can also be determined by conventional tests.

Some examples of Md temperatures are as follows:

| AISI stainless steel type no. | Md temperature (°C.) |
|---|---|
| 301 | 43 |
| 302 | 13 |
| 304 | 15 |
| 304L | 18 |

The 301, 302, 304 and 304L steels have Ms temperatures below minus 196° C.

As noted, the deformation referred to is a mechanical deformation and takes place in the range of plastic deformation, which follows the range of elastic deformation. It is caused by subjecting the material to a stress beyond its elastic limit sufficient to change the shape of all or part of the workpiece.

In U.S. Pat. No. 4,042,421 issued Aug. 16, 1977 to Van den Sype, et al. for "A Method for Providing Strong Tough Metal Alloys", high strength and toughness as well as high torsional yield strengths in wire are achieved by deformation at ambient temperatures and uniaxial stretching at cryogenic temperatures.

The strength property can readily be determined from a simple uniaxial tensile test as described in ASTM standard method E-8. This method appears in part 10 of the 1975 Annual Book of ASTM Standards published by the American Society for Testing and Materials, Philadelphia, Pa. The results of this test on a material can be summarized by stating the yield strength, tensile strength, and total elongation of the material: (a) the yield strength is the stress at which the material exhibits a specified limiting deviation from the proportionality of stress to strain. In this specification, the limiting deviation is determined by the offset method with a specified 0.2 percent strain; (b) the tensile strength is the maximum tensile stress which the material is capable of sustaining (tensile strength is the ratio of the maximum load during a tension test carried to fracture to the original cross sectional area of the specimen); and (c) the total elongation is the increase in gauge length of a tension test specimen tested to fracture, expressed as a percentage of the original gauge length. It is generally observed that when the yield and tensile strengths of metallic materials are increased through metallurgical processes, the total elongation decreases.

In order for wire to be satisfactory for use in highly stressed structures, it is also important that the wire have adequate resistance to brittle failure (toughness). In this regard, metallurgical investigations have shown that sharp cracks can concentrate the applied stresses to a material manyfold and it was found that the behavior of the material under such stress concentrations at crack tips determine to a large degree whether the material is of a ductile or brittle nature. Fracture toughness of a material is a measure of its resistance to brittle failure in the presence of sharp cracks.

The torsional yield strength of wire can be determined by twisting a finite length of wire over increasing angles and observing when a first permanent angular distortion occurs. A two percent torsional yield strength is defined as the shear stress occurring at the surface of the wire when twisted over an angle sufficient to give rise to a two percent permanent angular offset. A similar definition holds for a five percent torsional yield strength. It is desirable that the torsional yield strength of a wire used for spring applications be as high as possible in relation to the tensile strength of the wire.

Wire applications in which the high strength-toughness-torsional yield strength combination is a prerequisite are exemplified by coil springs such as compression or extension springs.

It was noted in U.S. Pat. No. 4,042,421, mentioned above, that the process combining prestrain and low temperature deformation is an improvement over stretching wire at low temperatures, which, in its own right, has the advantages of (i) providing a higher tensile strength, independent from wire diameter, than drawing at low temperatures where the tensile strength is intimately related to the diameter, i.e., the greater the diameter, the lower the tensile strength; (ii) improved torsional yield strength; and (iii) eliminating the need for lubricants.

Stretching is defined as a deformation of workpieces in which one dimension, called the longitudinal direction, is much larger than the two other dimensions, e.g., wire. This deformation comprises applying forces in the longitudinal direction so that essentially the entire cross-section of the workpiece is under uniform *uniaxial* tensile stress during the deformation. The tensile stresses are of sufficient magnitude to induce permanent plastic deformation in the workpiece, the application of stress being described in terms of percent strain. Since the term "stretching" as used herein is in contradistinction in other deformation processes such as drawing which involves multiaxial states of stress, the term "stretching . . . uniaxially" has been used to further accentuate the difference for as those skilled in the art will recognize the longitudinal elongation of a wire during *drawing* through a die occurs under the influence of compressive stresses in directions transverse to the drafting direction in addition to the tensile stresses in the drafting or longitudinal direction.

The second step prescribed in a preferred embodiment of the prior art may be considered a non-drawing step to emphasize the importance of uniaxial stretching and exclude the techniques whereby the workpiece is not uniformly strengthened, i.e., where the skin portion is highly strengthened while the core portion is strengthened to a much lesser degree, thus limiting the tensile strength of the drawn wire to that at which the skin portion cracks or ruptures. This deficiency in drawn wire leads to further problems in a specific application, i.e., that of coil springs, where formability is of special interest. In this case, the skin portion has to be sufficiently ductile to withstand wrapping without fracture about an arbor with a diameter at least equal to the diameter of the wire, but, unfortunately the preferential work-hardening of the skin during drawing causes the skin to become more brittle and less ductile thus reducing formability.

The low temperature stretching process is shown to have improved tensile strength and formability as well as torsional and fatigue properties. The prestrain step improves even further on the tensile strength and toughness of the wire thus further upgrading these materials for commercial use.

It was found, however, that cryogenic stretching had several practical limitations.

To overcome these deficiencies, the art turned back to cryogenic drawing with a modification which minimized fracture, optimized uniform strain capability, produced constant diameter wire, and eliminated sizing. This process of modified cryogenic drawing utilizes back-tension and is described in U.S. patent application Ser. No. 902,567, filed by Van den Sype, et al. on May 3, 1978 for "A Method for Providing Strong Wire", which is incorporated by reference herein. In this application, the invention is defined as a process in which a wire composed of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C. and an Ms temperature of no higher than about minus 100° C., undergoes the following steps:

(a) deforming the wire at a strain of at least about 10 percent and at a temperature in the range of about Md minus 50° C. to about Md plus 50° C., said Md temperature being that of the alloy undergoing deformation, in such a manner that the wire has a martensite phase of no greater than about 10 percent by volume and an austenite phase of at least about 90 percent by volume and a yield strength in the range of about 130,000 psi to about 230,000 psi;

(b) cooling the wire to a temperature no higher than about minus 75° C.; and (c) drawing the cooled wire through a die under back-tension (i) wherein the back-tension on said wire just prior to the entry of the wire into the die is at least about 75,000 psi and (ii) whereby the cross-sectional area of the wire is reduced by a percentage in the range of about 7 percent to about 25 percent, in such a manner that the wire has a martensite phase of at least about 50 percent by volume and an austenite phase of at least about 10 percent by volume.

The strain applied in step (a) will on occasion be referred to in this specification as "prestrain".

Final optimization of the strength properties is achieved by subjecting the wire to conventional aging at a temperature in the range of about 350° C. to about 450° C.

The alloys to which the process is applied are described above and, as noted, are conventional. AISI series 300 alloys are preferred, particularly AISI 302 containing C,Ni, Cr, and Mn. For spring wire applications, it is suggested that 302 alloy be used and that certain components of the 302 alloy fall within the following ranges (in weight percent): nickel 8.0 to 9.0; chromium 17.5 to 19.0; carbon 0.085 to 0.115; manganese less than 1; silicon 0.2 to 0.5; nitrogen 0.02 to 0.08; molybdenum, less than 0.6; sulfur, less than 0.01; and phosphorous, less than 0.035. It is desirable to minimize inclusions.

The deformation is mechanical and takes place in that region known as the region of plastic deformation. The mechanical deformation techniques which can be used both in the first and second deformation steps, steps (a) and (c), again are conventional as well as the apparatus availed of to carry out these techniques.

The deformation are, of course, sufficient to provide the stated percentages of martensite and austenite, which are first determined by conventional analytical techniques such as X-ray diffraction or magnetic measurements and then on the basis of the experience of the operator with the various alloys on deformation in the noted temperature ranges. To more accurately define the deformation in step (a), which can be carried out, e.g., by stretching or drawing, it has been set forth in terms of strain. Although the strain occurring during process deformation is usually more complex than those occurring during a simple tension test, it is found for the materials to which the invention applies, the strengthening effects that occur during complex deformations can be evaluated from the observed strenghtening effects during a simple tension test using the principle of "equivalent uniaxial" strain or "effective" strain as set forth, e.g., in "Mechanical Metallurgy" by G. E. Dieter, Jr., published by McGraw-Hill Book Company (1961), on page 66.

Where a deformation step is performed by drawing through a die, the amount of deformation is conventionally described by the reduction in cross-sectional area of the wire after it passes through the die. This area reduction (RA) is related to the equivalent uniaxial strain (E) by the formula:

$$E=RA/(1-RA)$$

The minimum strain in step (a) deformation is at least about 10 percent. There is no upper limit for percent strain except that of practicality in that at a certain point the change in microstructure and strength-toughness properties become minimal and, of course, there is a limit as to fracture of the material. In any case the suggested strain range in this first step is from about 10 to about 80 percent and, preferably, about 20 to about 60 percent.

As pointed out, the initial alloy utilized in the process is at least about 95 percent by volume austenite, the balance being martensite. Under deformation in step (a) (or prestrain), the alloy may be changed slightly from a microstructural point of view so that 0 to about 10 percent by volume is in the martensite phase and about 90 to about 100 percent by volume is in the austenite phase, and there is, preferably, 0 to about 5 percent by volume martensite and about 95 to about 100 percent by volume austenite.

The prestrain step is conducted at a temperature in the range of about Md minus 50° C. to about Md plus 50° C., preferably about Md minus 10° C. to about Md plus 10° C., said Md temperature being that of the alloy undergoing deformation, e.g., where the Md temperature is 43° C., Md minus 50° C. will equal minus 7° C. and Md plus 50° C. will equal 93° C. The alloys under consideration here are considered stable, i.e., austenically stable, at these first step temperatures even though they undergo the changes set forth above when subjected to deformation.

In addition to providing a strain in step (a) which will give the requisite martensite-austenite content, the strain is further adjusted to provide yield strengths in the range of about 130,000 to about 230,000 psi. These particular yield strengths are obtained first by testing samples of the wire and then through the experience of the operator with the particular wire undergoing treatment, the temperature at which the step (a) deformation is undertaken, and the amount of strain used, the latter amount of strain usually being adjusted to accommodate the particular wire and temperature. It is suggested that prior processing such as annealing and prestrain be optimized to achieve a small grain size.

In step (b), the wire is cooled to a temperature no higher than about minus 75° C. and, preferably, less than about minus 100° C. These temperatures can be achieved by immersing the wire in liquid nitrogen (B.P. minus 196° C.); liquid oxygen (B.P. minus 183° C.); liquid argon (B.P. minus 186° C.); liquid neon (B.P. minus 246° C.); liquid hydrogen (B.P. minus 252° C.); or liquid helium (B.P. minus 269° C.). Liquid nitrogen is preferred. A mixture of dry ice and methanol, ethanol, or acetone has a boiling point of about minus 79° C. and can also be used; however, the lower temperatures are preferred since, as is well known, the lower the temperature, the lower the amount of strain needed for each percent of improvement in tensile strength. The cooling step, step (b), must take place prior to drawing step (c). Steps (b) and (c) should be so coordinated that the time interval between the two steps is short enough to substantially avoid any temperature rise above the cooling temperature of step (b).

Step (c) is similar to step (a) insofar as deformation or strain is concerned, however, the deformation is defined in different terms. In any case, sufficient strain must be applied to provide the stated percentages of martensite and austenite, first determined by conventional analysis and then by reliance on operator experience. The minimum strain applied in the second deformation is at least about 10 percent. Here, also, there is no upper limit for percent strain except the bounds of practicality in that change in microstructure and strength-toughness properties tend to become minimal and there is a limit due to fracture of the material. The suggested strain range is about 10 to about 60 percent and is, preferably, about 20 to about 40 percent.

The dies which may be used in the drawing step are conventional, e.g., tungsten carbide drawing dies. The cone angle of the carbide nib is found to be optimally about 12 degrees. Larger die angles give rise to an excessive amount of redundant work of deformation resulting in less than optimum properties. Die angles smaller than 12 degrees have too large a bearing length and the increased friction between die and metal is also found to provide less than optimum properties particularly with respect to torsional yield.

The lubricants used for the wire and which are applied prior to drawing are also conventional. Typically, prior to step (b), the wire is precoated with lubricant. This precoat is applied by dipping the coils in standard precoat solutions. These solutions may contain lime or oxalate. Prior to entering the die in step (c), and after step (b) the wire passes through a box filled with a dry soap such as calcium stearate soap. To enhance, its passage through the die, the wire may also be copperated.

The drawing speed is fast enough to move the cooled wire through the lubricant and to the entrance of the die aperture before the temperature of the wire rises substantially above the cooling temperature of step (b).

It will be understood that once the wire is in the die, the work of deformation, the exothermic reaction of transforming austenite to martensite, and the friction may raise the temperature of the wire as much as about 200° C. where the wire was initially at liquid nirogen temperature. This adiabatic heating effect aids the performance of the conventional lubricants. Generally, the drawing speed is about 100 to about 800 feet per minute for wire diameters of about 0.04 inch to about 0.2 inch. The stated drawing speeds refer to the outgoing wire diameter, i.e., the diameter of the wire as it leaves the die. The drawing speed will be slower for larger diameter wire and faster for wire of thinner diameter, the most desirable speed being determined by the experience of the operator with the particular wire.

The term "back-tension" is defined as the stress in the longitudinal direction on the wire prior to entering the die. Stated back-tensions refer to the incoming wire diameter, i.e., the diameter of the wire as it enters the die. It is also referred to as "back-pull." Back-pull wire drawing is well-known and is discussed in the Journal of the Iron and Steel Institute, November, 1947, at pages 417 to 428 and in the Steel Wire Handbook, Volume 1, published by the Wire Association, Inc., Stamford, Conn., 1965, at pages 245 to 250. The preferred amount of back-tension is in the range of about 75,000 psi (517 Mpa) to about 150,000 psi (1,034 Mpa). The smoothest operation occurs with higher back-tension.

In step (c), the microstructure of the metal or alloy is changed appreciably so that at least 50 percent by volume is in the martensite phase and at least 10 percent by volume is in the austenite phase. The preferred range lies in the area of about 60 to about 90 percent by volume martensite and about 10 to about 40 percent by volume austenite. It is believed that the high austenite content contributes to the toughness of the processed material.

At all times in this specification the microstructure of the initial alloy and of the products of the prestrain, cryodrawing, and aging is considered to consist essentially of austenite and/or martensite in the percentages previously stated. Any other phases present are not of interest here since such phases, if they are present at all, are less than about one percent by volume and have little or no effect on the properties of the alloy.

It is noted that the ranges, in which the strain percentages for step (a) and step (c) lie, overlap. Although the percentages can be the same, it is preferred that the ratio of prestrain to drawing strain is in the range of about 1:1 to about 3:1.

After step (c), the alloy is preferably subjected to aging to optimize strength. Aging is carried out in a conventional manner at a temperature in the range of about 350° C. to about 450° C. and, preferably, in the range of about 375° C. to about 425° C. Aging time can range from about 30 minutes to about 10 hours and is preferably in the range of about 30 minutes to about 2.5 hours. Conventional testing is used here to determine the temperature and time, which give the highest strength properties. It will be noted, that aging tends to improve yield strength even more than tensile strength, and, for the alloy to reach the highest strength levels, can be carried to a point where yield strength approximates the tensile strength. Ratios of torsional yield strength to tensile strength, after aging, are found to be in the range of about 0.45 to about 0.49 when the back-tension process is carried out in the preferred manner.

Unfortunately, in order to achieve good torsional properties with back-tension, sizeable amounts of back-tension are required (greater than 80 percent of the tensile strength of the incoming wire). This high back-tension gives rise to a number of operational difficulties, particularly for large diameter wire and rod (hereinafter the term "wire" will be considered to include rod, which is merely large diameter wire). First of all, high back-tensions represent higher costs in view of the power needed for braking (a friction brake is used to apply the back-tension) and the larger equipment, e.g., shafts and bearings, required because of the force generated between the capstans, the larger the diameter wire, the greater the force. It will be understood by those skilled in the art that friction brakes, capstans, shafts and bearings are typical pieces of equipment used in the back-tension process. A second disadvantage of the back-tension process is the high amount of scrap generated. This comes about because the end of one coil is generally welded to the beginning of the next coil to maintain a continuous process. Since it is advisable to remove back-tension when the weld is drawn through the die to avoid weld fractures, a certain amount of wire must be scrapped. The scrap rate can amount to as much as 15 percent by weight with respect to, e.g., 0.3 inch diameter wire. A third difficulty is the limitation on drawing speed imposed by cooling the wire down to liquid nitrogen temperature; the larger the diameter wire, the longer the cool down time and thus the slower the drawing speed. Two more disadvantages of the back-tension process are the need for controls to keep the back-tension constant and the difficulty in stringing up the back-tension device, particularly with respect to large diameter wire.

There is a need, therefore, for a process, which will improve the strength characteristics of the described wire at least to the level provided by the back-tension process, but avoids the use of back-tension as defined and its attendant disadvantages.

SUMMARY OF THE INVENTION

Thus, an object of this invention is to provide an improvement in known cryodeformation processes whereby strengths at least as great as those of the back-tension process are achieved without the use of the defined back-tension.

Other objects and advantages will become apparent hereinafter.

According to the present invention, an improvement has been discovered in a process involving a wire composed of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C. and an Ms temperature of no higher than about minus 100° C., comprising the following steps:

(a) deforming the wire at a strain of at least about 10 percent and at a temperature in the range of about Md minus 50° C. to about Md plus 50° C., said Md temperature being that of the alloy undergoing deformation, in such a manner that the wire has a martensite phase of no greater than about 10 percent by volume and an austenite phase of at least about 90 percent by volume and a yield strength in the range of about 130,000 psi to about 230,000 psi;

(b) cooling the wire to a temperature no higher than about minus 75° C.; and (c) drawing the cooled wire whereby the cross-sectional area of the wire is reduced by a certain percentage and the wire has a martensite phase of at least about 50 percent by volume and an austenite phase of at least about 10 percent by volume.

The improvement comprises carrying out the drawing of step (c) by drawing the wire through two dies placed in series in such a manner that the cross-sectional area of the wire is reduced by the first die by a percentage in the range of about 8 to about 15 percent and the cross-sectional area of the reduced wire is further reduced by the second die by a percentage in the range of about 8 to about 15 percent based on the area of the wire exiting the first die.

As for the back-tension process, final optimization of the strength properties is accomplished by subjecting the wire to conventional aging at a temperature in the range of about 350° C. to about 450° C.

BRIEF DESCRIPTION OF THE DRAWING

The sole FIGURE of the drawing is a schematic diagram illustrating the side view of apparatus, which can be used to carry out the two die drawing step referred to above.

DESCRIPTION OF THE PREFERRED EMBODIMENT

The alloys are the same as those described for the back-tension process even as to the preferred alloys. Steps (a) and (b) are also the same. The mechanical deformation techniques such as stretching or drawing are generally conventional, drawing being preferred for step (a) and, of course, required in modified form for step (c). The applied strains, austenite-martensite content, yield strengths except for an upward revision in the minimum preferred yield strength, dies, and lubricants, microstructure, ratios of torsional yield strength to tensile strength are, again, as in the back-tension process.

The preferred yield strengths in steps (a) and (c) are in the range of about 160,00 psi to about 180,000 psi.

As noted, two dies are placed in series, the dies themselves being conventional. The wire passing through the first die is reduced in cross-sectional area by a percentage in the range of about 8 to about 15 percent based on the area of the wire entering the die. The preferred range is about 10 to about 14 percent. The so reduced wire is then passed through the second die where the cross-sectional area is further reduced by a percentage in the same range of about 8 to about 15 percent based on the area of the wire exiting the first die. The preferred range is about 8 to about 11 percent. The total area reduction from the area of the wire entering the first die to the area exiting the second die is in the range of about 16 percent to about 25 percent. A single bull-block located after the second die can be used to draw the wire through both dies. The two dies can be stacked together (about one inch apart, as a practical matter) or can be some distance apart, e.g., about 2 to about 10 inches. No intermediate cooling is required between the first and second dies.

The tensile stress is the wire between the first and the second die is equal to the drawing stress needed to pull the wire through the first die and this can be estimated by the application of the following formula:

$$Sd = 24 + 400 \log_e \frac{1}{1-R1}$$

wherein

Sd = the drawing stress in ksi $R_1$ = the area reduction in the first die $\log_e$ = natural logarithm It will be understood by those skilled in the art that the drawing stress placed some back tension on the wire in the second die, e.g., where $R_1 = 0.12$, Sd and back-tension will each equal about 75 ksi.

The process is particularly adapted to drawing wire above about 0.150 inch diameter finished size, this being considered large diameter wire.

The following examples illustrate the invention:

EXAMPLES 1 and 2

The wire in the examples contains at least 95 percent by volume austenite prior to the first deformation and at least 90 percent by volume austenite prior to drawing step (c). After drawing step (c) the wire contains at least 50 percent by volume martensite and at least 10 percent by volume austenite. Percent by volume martensite is determined by quantitative X-ray diffraction technique. The balance (to make up a total of 100 percent) is considered to be austenite. Other phases are not more than one percent by volume and are not considered here.

Annealed AISI type 302 stainless steel wire is used. The annealing is accomplished with conventional techniques by heating the wire between 980° C. and 1150° C. followed by rapid cooling.

The examples are carried out by following the steps described above with respect to the two die process, the cooling and drawing steps, steps (b) and (c), being carried out in the apparatus shown in the sole FIGURE of the drawing. Tensile strength, and torsional yield strength are determined as described above in the body of the specification.

Referring to the drawing, the wire 1, having been coated with a conventional lubricant precoat, is wound onto spool 2 which is placed in cooler 3 (an insulated metal dewar) containing liquid nitrogen 4 where it is precooled to minus 196° C. Moisture build-up on the cooled wire leaving spool 2 is avoided by use of a nitrogen shroud. After leaving cooler 3, wire 1 enters die 5, which is located in a die box filled with soap (a conventional lubricant), and is drawn through die 5 having an approach angle of 12 degrees. The drawing force is generated by means of conventional bull-block 7. Die 5 and its die box are not immersed in liquid nitrogen, but the travel time between cooler 3 and die 5 is sufficiently short that no appreciable heating occurs. In the same manner, wire 1 is drawn through die 6 and its die box (identical to die 5 and its die box) except that wire 1 exits die 5 and enters die 6 at a temperature of about minus 100° C. The dies are either stacked together or are about 4 inches apart in the examples.

The tensile strength is determined after drawing step (c) and then the wire is aged in a conventional manner at 400° C. for ½ hour in a Lindberg Model 59744 furnace in air. The surface oxidation of the wire occurring during aging is assumed not to affect the resulting mechanical properties. The temperature along the length of all specimens does not vary more than ±10° C. from the preset temperature.

The wire of all of the examples shows adequate formability in that it can be wrapped around an arbor equal to the final wire diameter without fracture.

After aging, the torsional yield strength is determined.

The chemical composition of the alloys used in the examples is as follows (weight percent):

| | |
|---|---|
| Cr | 17.7 |
| Ni | 8.17 |
| Mn | 0.62 |
| C | 0.100 |
| S | 0.015 |
| Mo | 0.14 |
| Cu | 0.14 |
| N | 0.053 |
| Si | 0.38 |
| P | 0.022 |
| Fe | balance |

Prestrain is accomplished by conventional drawing in accordance with step (a). After prestrain, the wire specimen of Example 1 is 0.134 inch in diameter and has a tensile strength of 176,000 psi (1214 Mpa) (psi=pounds per square inch and Mpa=megapascal). Die 5 and die 6 are stacked together. Die 5 reduces the wire to 0.127 inch diameter (10.2 percent area reduction) and die 6 reduces the wire to 0.118 inch nominal diameter (13.7 percent area reduction). The total area reduction in both dies is 22.5 percent. The torsional yield strength at 2 percent and 5 percent permanent set of the aged wire follows:

at 2%: 135 ksi (931 Mpa)

at 5%: 181 ksi (1248 Mpa)

ksi=1000 psi

The prestrain for example 2 specimens (three) is carried out by conventionally drawing 0.235 inch diameter hot rolled, annealed, and pickled rod to 0.181 inch diameter (40.7 percent area reduction) and a tensile strength of 179,700 psi (1239 Mpa) according to step (a). The nominal finished wire size for all three specimens after passing through the double die process is 0.161 inch diameter with a total reduction in area of 20.9 percent.

For specimen (a), the two dies are stacked together and the first die has a nominal opening of 0.169 inch diameter (to provide a 12.8 percent reduction in area); for specimen (b), the two dies are about four inches apart and the first die has a nominal opening of 0.169 inch (to provide a 12.8 percent reduction in area; and for specimen (c), the two dies are stacked together and the first die has a nominal opening of 0.171 inch diameter (to provide a 10.7 percent reduction in area). The torsional yield strength at 2 percent and 5 percent set of the aged wire and the tensile strength before and after aging are as follows:

| Specimen | Torsional Yield Strength | | Tensile strength | |
|---|---|---|---|---|
| | 2% | 5% | Unaged | Aged (½ hr. at 800° F.) |
| | ksi (Mpa) | ksi (Mpa) | ksi (Mpa) | ksi (Mpa) |
| (a) | 147 (1,014) | 190 (1,310) | 266.9 (1,841) | 279.5 (1,928) |
| (b) | 150 (1,034) | 187 (1,290) | 263.4 (1,817) | 278.1 (1,918) |
| (c) | 135 (931) | 182 (1,255) | 266.6 (1,838) | 279.2 (1,926) |

Note:
optimum reduction in area for first die is about 12 percent; the closer to optimum, the greater the torsional yield strength, specimen (c) having a lower torsional yield strength than specimens (a) and (b).

I claim:

1. In a process for improving the strength characteristics of a wire composed of an austenitic metal alloy selected from the group consisting of stainless steel alloys of the AISI 200 and 300 series and non-stainless steel alloys containing iron, manganese, chromium, and carbon, said alloy having an Md temperature of no higher than about 100° C. and an Ms temperature of no higher than about minus 100° C., comprising the following steps:

(a) deforming the wire at a strain of at least about 10 percent and at a temperature in the range of about Md minus 50° C. to about Md plus 50° C., said Md temperature being that of the alloy undergoing deformation, in such a manner that the wire has a martensite phase of no greater than about 10 percent by volume and an austenite phase of at least about 90 percent by volume and a yield strength in the range of about 130,000 psi to about 230,000 psi;

(b) cooling the wire to a temperature no higher than about minus 75° C.; and (c) drawing the cooled wire thereby by the cross-sectional area of the wire is reduced by a certain percentage and the wire has a martensite phase of at least about 50 percent by volume and an austenite phase of at least about 10 percent by volume, the improvement comprising carrying out the drawing of step (c) by drawing the wire through two dies placed in series in such a manner that the cross-sectional area of the wire is reduced by the first die by a percentage in the range of about 8 to about 15 percent and the cross-sectional area of the reduced wire is further reduced by the second die by a percentage in the range of about 8 to about 15 percent based on the area of the wire exiting the first die.

2. The process defined in claim 1 wherein the area of reduction in the first die is in the range of about 10 to about 14 percent and the area of reduction in the second die is in the range of about 7 to about 11 percent.

3. The process defined in claim 2 wherein the two dies are stacked together.

4. The process defined in claim 2 wherein the exit of the first die is about 2 to about 10 inches from the entrance to the second die.

5. The process defined in claim 2 wherein the finished wire size is at least about 0.150 inch diameter.

* * * * *

UNITED STATES PATENT AND TRADEMARK OFFICE

CERTIFICATE OF CORRECTION

PATENT NO. : 4,204,885

DATED : May 27, 1980

INVENTOR(S) : Jaak S. Van den Sype

It is certified that error appears in the above-identified patent and that said Letters Patent are hereby corrected as shown below:

Column 12, line 31, change "thereby" to --whereby--; line 49, change "7" to --8--; and line 56, after "inch", insert --in--.

Signed and Sealed this

*Nineteenth* Day of *August 1980*

[SEAL]

*Attest:*

SIDNEY A. DIAMOND

*Attesting Officer*

*Commissioner of Patents and Trademarks*